United States Patent [19]

Rieber et al.

[11] 3,989,414

[45] Nov. 2, 1976

[54] PUMP FOR SERVO STEERING

[75] Inventors: Roland Rieber, Mogglingen; Rolf Fassbender, Mutlangen, both of Germany

[73] Assignee: Zahnradfabrik Friedrichshafen AG, Friedrichshafen, Germany

[22] Filed: Mar. 26, 1975

[21] Appl. No.: 562,240

[52] U.S. Cl. ..... 417/300; 60/494; 137/117

[51] Int. Cl.[2] ..... F04B 49/00

[58] Field of Search ..... 417/300, 307, 310; 137/117

[56] References Cited

UNITED STATES PATENTS

| | | | |
|---|---|---|---|
| 3,207,077 | 9/1965 | Zeigler et al. | 417/310 X |
| 3,426,785 | 2/1969 | Brady et al. | 137/117 |
| 3,547,559 | 12/1970 | Tittmann | 417/300 X |
| 3,645,647 | 2/1972 | Ciampa et al. | 417/310 X |

*Primary Examiner*—William L. Freeh
*Assistant Examiner*—Edward Look

[57] ABSTRACT

A motor vehicle servo steering system control for flow rate to the hydraulic steering cylinder mechanism utilizes a flow regulating bypass valve between the inlet and outlet of the system pump. A throttle bore device in the pump outlet is adjustable as to bore position to effect a variable operating pressure differential on the flow regulating valve bypass of the pump. The purpose of the arrangement is to effect as constant as possible a rate of flow to the steering servo cylinder mechanism at any given speed but with lowering of rate of flow when pump speed is increasing with engine speed. Accordingly, the invention provides a generally uniformly varying decrease in the amount of steering assist which a vehicle driver receives with increase in vehicle speed so as to convey a safer sense of road reaction at high speeds than would otherwise occur.

5 Claims, 4 Drawing Figures

FIG. 3
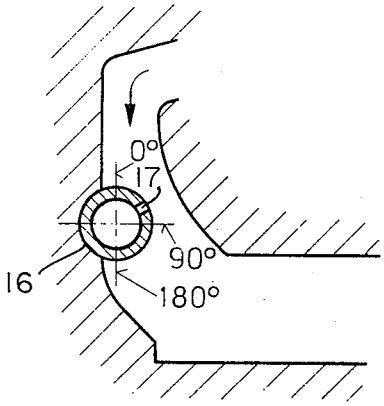
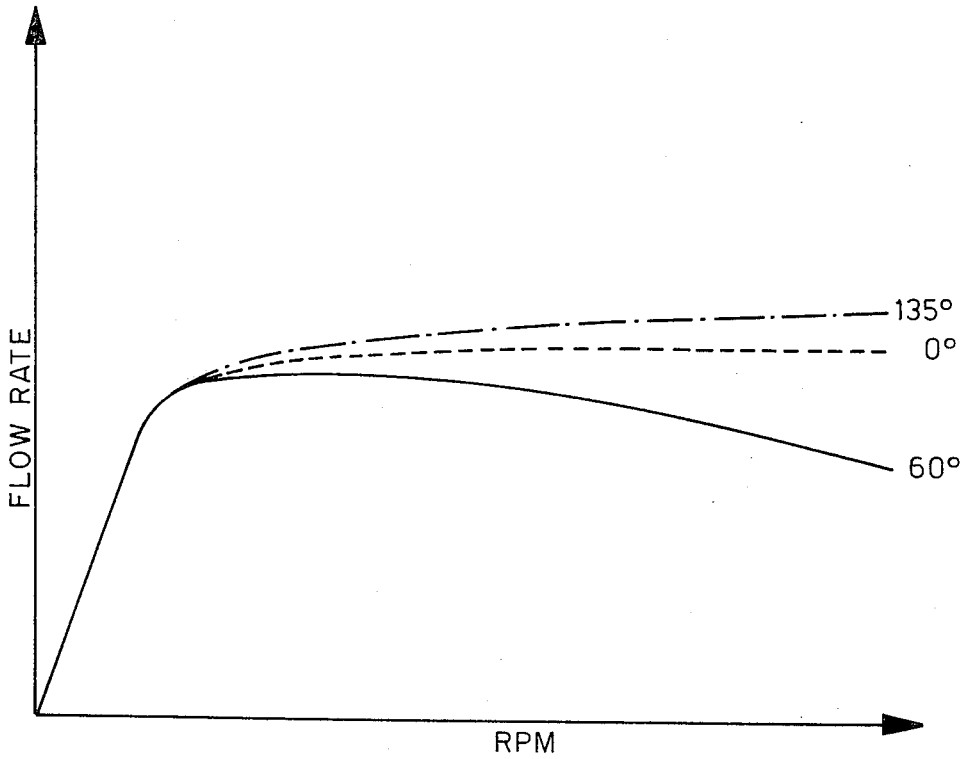
FIG. 4

PUMP FOR SERVO STEERING

Prior art known to applicant particularly pertaining to the flow regulating valves in booster steering systems are disclosed in U.S. Pat. Nos. 3,207,077 and 3,426,785. The latter patent shows a dual throttle arrangement in a pump bypass system which has the effect of lowering flow rate at increased speed by shutting off flow through one throttle. However, that expedient in a two stage action is not for applicant's purpose. The device of applicant's invention provides for continuous servo flow decrease with continuous speed increase. This maintains a fairly constant increase of driver effort needed for steering the faster the vehicle moves, so as to keep him constantly and progressively aware of his road speed in an approximately quantitative sense.

A detailed description now follows in conjunction with the appended drawing, in which:

FIG. 3 is a radial section of a throttle member having a throttle bore according to the invention, illustrating several positions of the throttle bore, and FIG. 4 is a graph of pump flow rate as a function of pump speed, i.e., RPM, correlated with the several positions of the throttle bore as illustrated in FIG. 3.

Figure 1:
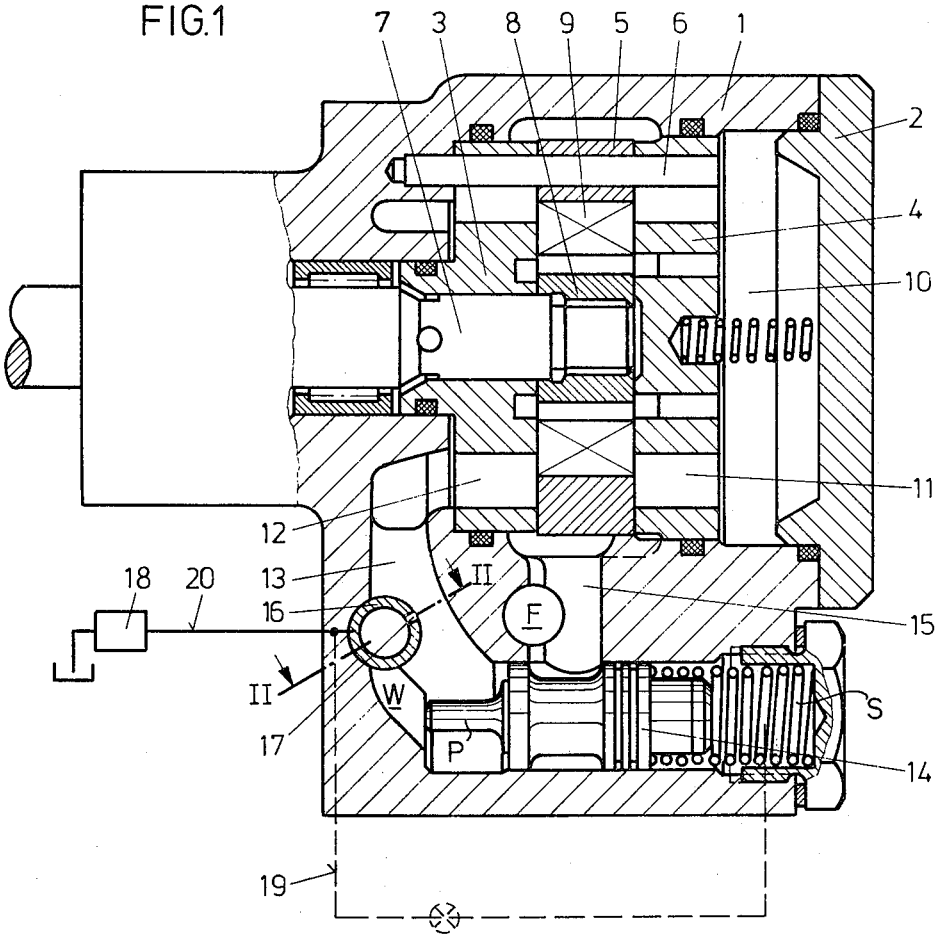
FIG. 1 is an elevation in section of an assembly of the essential components of the invention.
Figure 2:
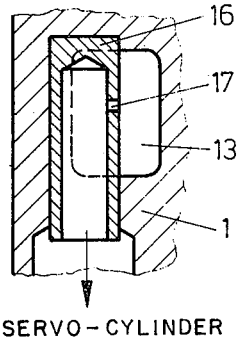
FIG. 2 is a section through II—II of FIG. 1.

Referring to FIGS. 1 and 2, the essential components of the invention comprise a housing 1 with an end cover 2 containing cheek plates 3 and 4 for a steering booster pump of the vane type comprising an outer eccentric ring 5 secured as by pins such as 6. An engine driven shaft 7 rotates the inner hub 8 which carries sliding vanes 9, all in conventional arrangement, pumping from feed passage F via suction chamber inlet 15 to a pressure chamber 10 and thence via passages 11 and 12 to a pressure channel 13 which connects with a flow regulating spool valve 14, effecting when shifted to the right a bypass from pressure channel 13 to suction passage 15 of the pump.

Located in channel 13 is a throttle member in the form of a cup 16 having a throttle bore or passage 17 of fixed dimension as shown exposed to flow in channel 13. The cup 16 may be secured in suitable aligned bores across channel 13 as shown in FIG. 2, pressure fluid in channel 13 having access through throttle bore 17 to the interior of the cup and thence outwardly via the open end to a servo cylinder mechanism 18 via pressure line 20.

A control line 19 taps off from line 20 for connection to the right side of valve 14, with a suitable throttle in line 19.

In FIG. 1, valve 14 is shown in the normal bypass cut-off position maintained by the valve spring S with the valve pin P abutting a wall W designed into passage 13 as a limit stop. It will be understood that when pressure in channel 13 overcomes the spring force and the back pressure effected via line 19, the valve 14 will shift to the right and bypass flow from the suction to the pressure sides of the pump, thereby reducing flow rate via line 20 to the servo cylinder mechanism 18.

A particular object of the invention is to so locate throttle member 16 in channel 13 and also to so orient the axis of throttle bore 17 in that passage that the effect of pressure increase with pump speed increase will operate the valve 14 so as to provide an inverse flow rate characteristic as a function of pump speed which characteristic changes generally uniformly and smoothly, e.g., the curve for 60° seen in FIG. 4.

It will be noted that the throttle member 16 can be placed in various positions longitudinally and transversely of the pressure channel 13, although as shown in FIG. 1 it is approximately in the center of the passage both longitudinally and transversely. Actually, the transverse position is controlling and throttle member 16 protrudes about half way into channel 13, to form a flow throat establishing a lower static pressure in the region where flow passes the throttle member than upstream of that region whereby the entry pressure to throttle bore 17 is predetermined. By providing a predetermined lower static entry pressure at the upstream side of bore 17, the differential pressure of the bypass regulating valve 14 can be predetermined in conjunction with the pressure fed to steering mechanism 18 via the passage means comprising throttle member 16, which branches to the spring end of the valve 14 via line 19 and an intermediate throttle in that line.

A desired sensitivity of actuation of valve 14 can thus be achieved, the pressure existing in pressure chamber 10 being decreased before being transmitted to the regulating valve via channel 13. Such output pressure of the pump is thus transmitted from chamber 10 to one face of valve 14 while the other face is exposed to the throttled down pressure resulting from bore 17. Differential pressure effecting forces in opposite directions on portions of valve 14 is thus determined via line 19, an effect of throttle bore 17 as a function of the angular position of the bore axis in channel 13 and by unthrottled pressure via pressure channel 13.

Referring to FIG. 3, it will be noted that throttle member 16 can be rotated about its axis so as to orient throttle bore 17 in a predetermined position at various angles, four such angles being illustrated in FIG. 3, the axial position of bore 17 being approximately 60° to the flow path at its narrowest region which is effected by the protrusion of cup member 16 into channel 13, assuming the flow path is generally vertical.

The novel effect of the angle position of bore 17 is well illustrated in the graph of FIG. 4 showing the ordinate, flow rate, plotted against the abscissa, speed or rpm of the pump, a function of engine speed. Thus the dash-dot line depicting a bore 17 position of 135° in relation to the flow path in channel 13 effects a slightly rising characteristic curve of the kind heretofore achieved in conventional arrangements. Similarly, at 0° where bore 17 faces directly into the flow, a fairly flat characteristic is effected as indicated by the dash line. However, with a bore 17 orientation of 60°, the novel effect of a drooping characteristic is achieved. It will be particularly noted that bore 17 is located essentially in the narrowest cross-section of channel 13 and thus within the area of the lowest static pressure, in this case. The drooping or downwardly sloping curve for the 60° orientation of the throttling bore produces an equally smooth and continuous decrease in flow rate as the pump speed increases and thereby conveys to the vehicle operator a decreasing servo-assist as the vehicle speed increases. This effect provides the operator with an augmented sense of driving danger since at the higher speeds he must use more physical power to achieve steering.

It will be recognized that there are certain structural similarities between the present invention and the prior art as exemplified in the previously mentioned U.S. Pat.

No. 3,207,077. However, the advantages of the present invention are obvious in that the throttle member, in the form of a cup, can be inserted so as to orient throttle bore 17 at any particular angle to suit various applications and frictionally held into position by force fit between the cup member 16 and the housing socket and bore which secures it as is evident in FIG. 2. Further, the flexibility of the invention in that the cup member is rotative adjustably for precise setting of the throttle bore axis is evident. While it would appear from FIG. 4 showing an actual experimental graph that a 60° angle between the throttle bore axis and the direction of flow (assumed vertical in FIG. 1) of the pressure fluid in channel 13 is optimum for applicants' purpose, it will be recognized that various conditions of oil viscosity and expected temperatures as well as throttle bore dimensions and throttle member passage diameter as well as other factors, might dictate some other predetermined angle for effecting the desired group and characteristic result.

What is claimed is:

1. In combination with an engine driven servo pump having suction and pressure chambers, pressure regulating valve means for conducting by-pass flow of fluid between said chambers and a fluid pressure operated device to which fluid under pressure is conducted from the pressure chamber; flow regulating means for decreasing the flow rate of said fluid to the pressure operated device in response to increase in speed of the engine above a predetermined value, comprising pressure channel means establishing a flow path along which unthrottled flow of the fluid is conducted from the pressure chamber to the pressure regulating valve means, and orifice flow means mounted in the pressure channel means independently of the pressure regulating valve means for conducting a continuous throttled flow of fluid to the pressure operated device as a function of the flow rate, said orifice flow means comprising a throttle member projecting into the flow channel means to establish a reduced static pressure region along said flow path, said throttle member having an orifice passage exposed to the fluid in the flow channel means in said reduced static pressure region.

2. The combination of claim 1, wherein said orifice passage is a throttle bore of fixed dimension extending transversely of said flow path.

3. The combination of claim 2, wherein said throttle member is an open ended cup protruding into the pressure channel means and angularly positioned to orientate said throttle bore at a predetermined angle to said flow path.

4. The combination of claim 2, wherein said throttle bore has an axis disposed at an angle between 0° and 180° relative to the direction of flow path in said pressure channel means.

5. The combination of claim 4, said throttle bore being disposed at an angle of approximately 60° to the direction of flow path in said pressure channel means.

* * * * *